United States Patent [19]

Romano

[11] 4,448,047

[45] May 15, 1984

[54] EMBROIDERY DEVICE FOR CROCHET MACHINES

[75] Inventor: Rancati Romano, Cilavegna, Italy

[73] Assignee: Rockwell Rimoldi, S.p.A., Milan, Italy

[21] Appl. No.: 404,992

[22] Filed: Aug. 4, 1982

[30] Foreign Application Priority Data

Jan. 29, 1982 [IT] Italy ..... 19360 A/82

[51] Int. Cl.[3] ..... D04B 23/00

[52] U.S. Cl. ..... 66/207

[58] Field of Search ..... 66/203, 207, 205

[56] References Cited

U.S. PATENT DOCUMENTS 3,952,549 4/1976 Kohl ..... 66/201

FOREIGN PATENT DOCUMENTS 545217 2/1932 Fed. Rep. of Germany ..... 66/203

2809391 6/1979 Fed. Rep. of Germany ..... 66/207

OTHER PUBLICATIONS

Wheatley, B., "Raschel Lace Manufacture", 1972, NY, Knitted Outerwear Assoc., pp. 188–190.

*Primary Examiner*—Ronald Feldbaum

[57] ABSTRACT

An embroidery device for crochet machines of the type having a looper arrangement and with a reciprocable needle bar for moving its needles into operative association with guide needles driven in an orbital pathway for loading warp threads carried thereby onto the needles of the needle bar. A plurality of bars driven in a rectangular pathway support tube elements through which weft threads are guided for linking them with the chains formed by warp threads. One of the rectangularly driven bars carries a plurality of guide tubes through which embroidery threads are guided. These guide tubes are also operatively connected to a supplementary vertical drive movement created by the pulling action of flexible members interconnecting the guide tubes with individual pulling elements. A pattern control unit is operatively connected to the pulling elements which are effective in causing the embroidery threads individual to each element to become linked within a chain so that it will not show on the fabric being formed or it is linked between two continuous chains when it is desired that it appear on the surface as part of a pre-selected design.

8 Claims, 6 Drawing Figures

EMBROIDERY DEVICE FOR CROCHET MACHINES

BACKGROUND OF THE INVENTION

The present invention pertains to an embroidery apparatus applicable to a crochet machine utilizing a looper device and which is adapted to form embroidery patterns of any desired configuration and arrangement whereby the patterns can be repeated at any desired location along the longitudinal length of a base fabric. These patterned designs are obtained by means of a device for inserting embroidery threads into the base fabric that is formed in a known manner by chains of warp threads concatenated with weft threads.

Crochet machines of the type described supra have never been provided with embroidery devices whereby it is possible to embroider letters, monograms and other pre-determined patterns directly into a base fabric that can be either an open or closed weave type fabric. Embroidery threads are utilized for the patterning effects and are visible at the required locations on the fabric and are hidden within the chains of warp threads when it is desired that only the base fabric be visible.

Embroidery patterns of the above type have, until the present invention, been manual operations performed by operators working at a so-called "lace-pillow". Certain manufacturers of crochet machines utilizing a looper device have unsuccessfully attempted to provide this type of embroidery by providing their machines with ten tube carrying bars. These attempts were not successful because of the extremely high manufacturing costs and of the complete unreliability of the final result. It is well known by those conversant in the art that it is necessary to provide the same number of glider chain elements as the number of points required for forming a desired ornamental pattern.

It is also known that the so-called open weave type fabric is formed by square openings, which are the easiest to form, and in which six chain elements are necessary for each opening, or in other words one for each striking operation of the machine and that each element is not less than 3 cm in length. Consequently, in order to provide an ornamental pattern of 20 cm in length which is equivalent to 180 square openings in the base fabric, it is necessary to provide a chain for each bar of at least 1080 glider elements having a total developed length of approximately 3.24 meters.

As the required number of chains is ten, the difficulties in locating each chain in close proximity with an adjacent chain is quite obvious as well as the problem of attempting to achieve the degree of accuracy required by each glider element at whatever operating speeds such machines may have. Consequently, each attempt has immediately been discouraged. Finally, when using chains it is not possible to detach an ornamental design from the one which follows it or to make them different if additional glider elements are not provided which if added to those required by the desired ornamental pattern, would create an excessive lengthening of the chains that are already considered extremely long.

It is a general object of the invention to provide an embroidery device for crochet machines that will form patterns of any desired configuration and which will not require manual intervention on the part of the machine operator.

A further object is to provide an embroidery device that can be controlled to form a particular pattern at any desired location along the longitudinal length of a base fabric.

The embroidery device according to the invention is operatively connected to one of the plurality of rectangularly driven bar members which support the tube elements through which the machine weft threads are guided. This bar member carries a plurality of guide tubes through which embroidery threads are guided for forming all the desired designs or embroidered patterns which can be obtained with not less than 76 bar members and which would have to be subjected to translatory movements by means of an equal number of glider chains.

SUMMARY OF THE INVENTION

The embroidery device comprising the invention is applicable to a crochet machine having a looper arrangement as well as a movable needle bar with needles and a guide bar for the guide needles that support the warp threads. The guide needles are driven in an orbital pathway to effect the loading of each needle and one of the bar members that normally supports the tube elements for guiding the machines weft threads, is utilized to support guide tubes through which embroidery threads are guided. The bar members are driven in a rectangular pathway for linking the weft threads to form a base fabric and the single bar member having guide tubes for the embroidery threads is, in addition to being driven in a rectangular pathway, subjected to a supplementary vertical drive movement. The combination of these devices is effective in linking the embroidery threads between the continuous chains at locations on the base fabric where it is desired that an embroidered pattern should be visible. Additionally, this means of manipulating the embroidery threads is effective in inserting said threads into the warp chains when it is desirable that only the base fabric be visible.

The embroidery device includes a pattern control unit operatively connected to guide tube pulling elements by means of flexible elements or cords and in accordance with the dictates of said control unit some of said tube pulling elements will be activated and others remain inactive as governed by a predetermined pattern. This pattern control unit includes pattern cards of the punched type having sensing elements operatively associated with the cards whereby in accordance with a particular pattern certain of said sensing elements will pass through the holes in the cards to effect actuation of certain tube pulling elements and others will simply ride on the surface of the card so that other tube pulling elements remain inactive.

A driven member for the guide tube pulling elements travels in a rectangular pathway that includes an upward movement for extracting the sensing elements from the holes in the cards, a horizontal translatory movement for effecting movement of selected tube pulling elements, a downward movement for lowering the sensing elements after a pattern case has been advanced and a second horizontal translatory movement in the opposite sense for locating the driven member in readiness to repeat the cycle.

Other objects and advantages of the invention will become more fully apparent by reference to the appended claims and as the following detailed description proceeds in reference to the figures of drawing wherein:

DESCRIPTION OF THE PREFERRED EMBODIMENT

Figure 1:
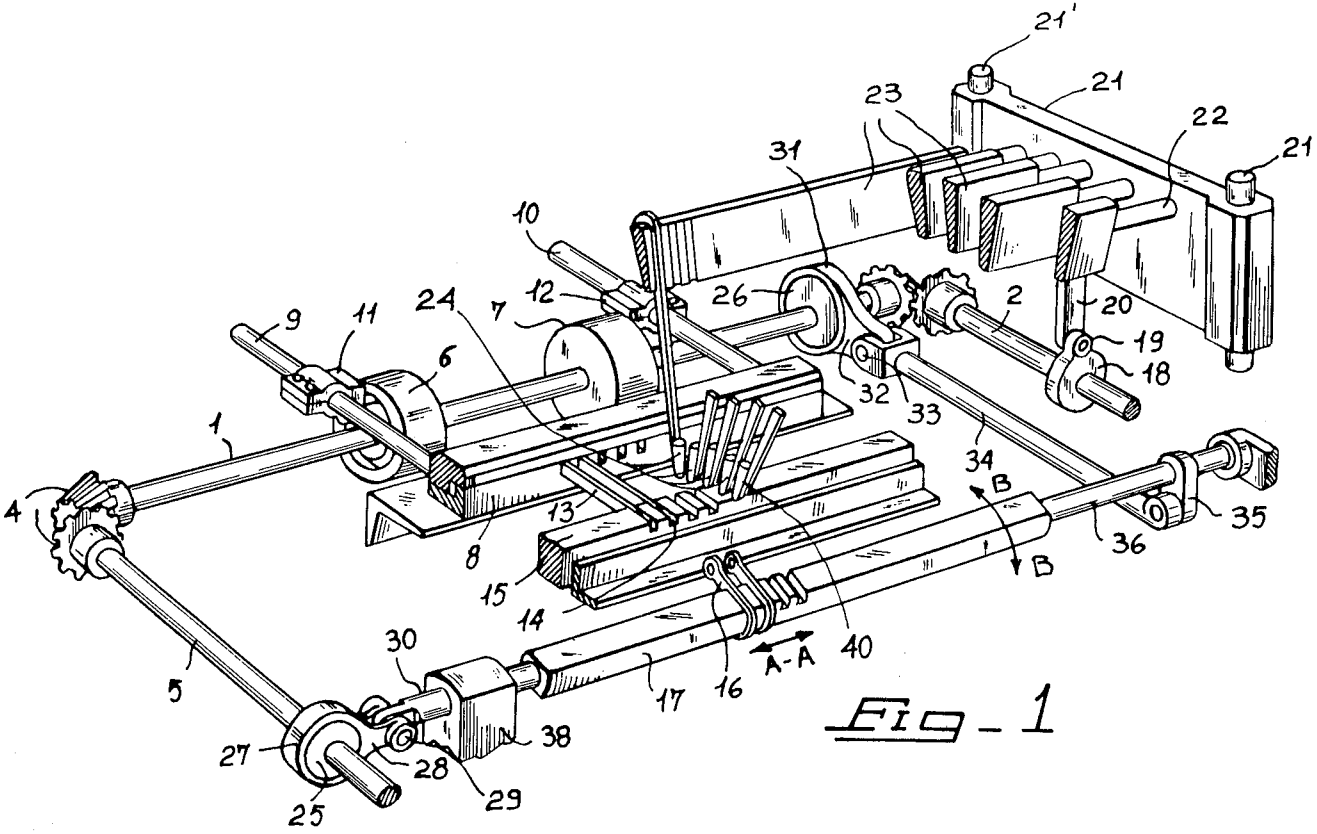
FIG. 1 is a perspective view of a portion of a crochet machine to which the embroidery device according to the invention is applicable.

In the embodiment shown in the drawing, only those parts of a crochet machine have been shown which are required for a complete understanding of the invention.

In the drawing, the machine's main shaft is identified by numeral 1 and is rotatably driven in a conventional manner by the machine's drive motor not shown. The machine further includes a shaft 2 and a shaft 5 which are rotatably driven by means of bevel gearing 3 and 4 respectively that operatively connects them with the main shaft 1. The main shaft 1 has a pair of face cams 6 and 7 mounted in spaced relation thereon and in a well-known manner provide the horizontal to and fro movement to a needle bar 8 by means of rods 9 and 10 which respectively include cam followers 11 and 12 that are caused to follow the grooves or channels in said face cams.

The needle bar 8 has the butt end of a plurality of needle 13 anchored therein and extending from said needle bar, the forward portion of the needles are guided in individual grooves 14 provided in a stationary needle guide bar 15 during operation of the machine.

To form chains from the warp threads OR (FIG. 2) said threads are arranged to extend through eyelets provided in individual warp thread guides or guide needles 16 that are assembled on a guide bar 17 which by means yet to be described is simultaneously driven through a longitudinal reciprocating movement and an angular oscillatory movement which are depicted in FIG. 1 by the indicating arrows A—A and B—B respectively.

The shaft 2 has a cam member 18 fixed thereon which is engaged by a roller 19 carried on the lower end of a bar 20 that depends from and which is attached to the lower edge of a plate element 21. This plate element 21 is provided with a plurality of openings through which cylindrical end 22 of bar members 23 are caused to extend. Bar members 23 are adapted to support a plurality of tubular weft guides 24. The weft threads TR (FIG. 2) extend from their source through the tubular guides 24 which are caused to manipulate said weft threads so that they become linked with the warp threads being fed to the needles 13 by the guide needles 16.

Although not shown in the drawing, the bar members 23 extend to a position above and to the left of the shaft 5 and are provided with cylindrical ends which are slidable supported in openings provided in a plate element the same as plate element 21. Additionally, the plate element not shown is operatively associated with a cam member on shaft 5 which is identical to and in phase with cam member 18. The combination of these cam members provide the necessary vertical movement of the plate elements on their cylindrical supports 21' and thus the tubular guides 24 on the bar members 23.

As shown in FIG. 1 the machine is provided with a pair of eccentric members 25 and 26 which are mounted on shafts 5 and 1 respectively and serve to effect the simultaneous longitudinal and angular movements of the guide bar 17 with its guide needles 16. The eccentric member 25 is operatively connected to an actuating lever 27 having an arm 28 with an end 30 of the guide bar 17 pivotably connected thereto as at 29 for effecting longitudinal movement of said guide bar in the directions of the indicating arrows A—A in FIG. 1.

The eccentric member 26 is operatively connected to an actuating lever 31 having an arm 32 that is pivotably connected to the bifurcated end of a rod 34 as at 33. The opposite end of rod 34 is pivotably connected to an arm 35 that is fixed on an adjacent the end of the guide bar 17 identified by numeral 36. This arrangement is effective in causing the guide bar 17 to oscillate in the directions depicted by the indicating arrows B—B in FIG. 1.

The eccentric members 25 and 26 being located on shafts 5 and 1 respectively are suitably phased with respect to one another and possesses sufficient eccentricity whereby the eyes of the guide needles 16 on the guide bar 17 are caused to travel in an orbital pathway about a particular needle so as to effect the loading of a warp thread thereon.

Figure 6:
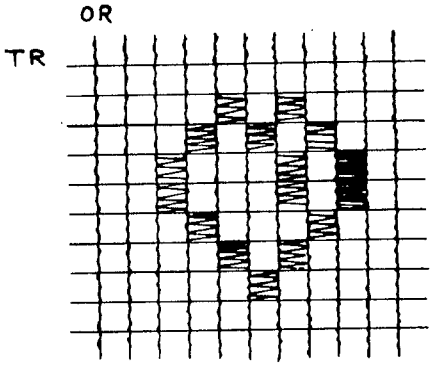
FIG. 6 is a schematic view of one of the embroidered designs capable of being formed by the invention.

With known crochet machines having a looper arrangement such as shown and described in Italian Patent Application No. 21918 A/81 filed May, 22, 1981, the concatenation of the chains of warp threads is accomplished by loading said threads, depicted by the letters OR, from the guide needles 16 onto needles 13 during the formation of the base fabric (FIG. 6). The fabric consists of uniformly spaced vertical chains and weft threads TR linked therewith so as to form a concatenated structure having uniformly disposed openings that define a perforated base fabric. If the chains on the other hand are formed in close proximity with one another, the concatenated structure becomes sufficiently dense so as to produce a compact and full fabric.

Figure 4:
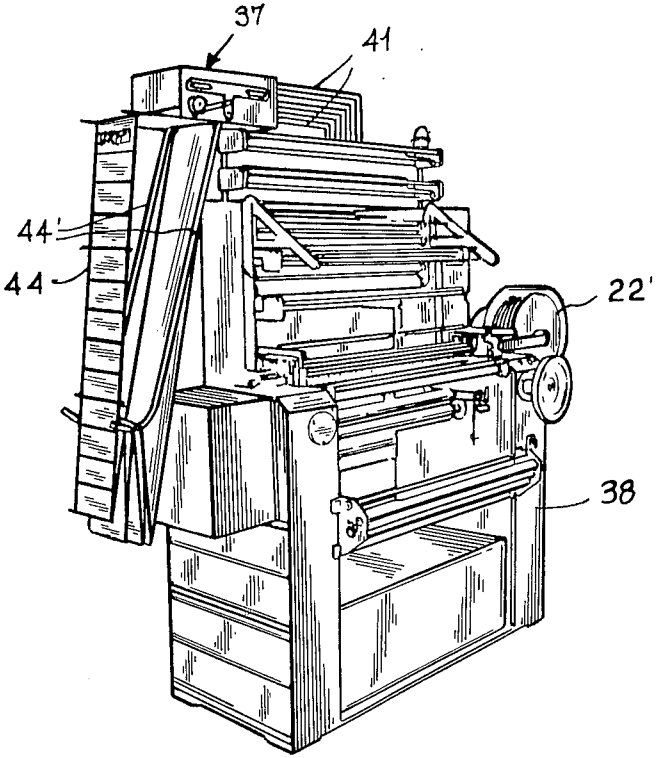
FIG. 4 is a perspective view of a crochet machine with the device according to the invention applied thereto.
Figure 5:
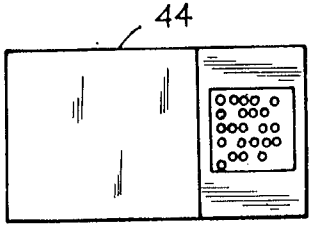
FIG. 5 is a top view of a pattern card of the punched type.

The embroidery device comprising the invention and which will be described in greater detail hereinafter, serves to manipulate one or a plurality of embroidery threads OP so as to partially fill the openings in the base fabric and is effective in covering pre-selected areas of the base fabric in accordance with a pre-selected pattern. As shown in FIG. 4 the embroidery device includes a pattern control unit generally identified by numeral 37 and is mounted in the upper left hand portion of the machine's frame 38.

The pattern control unit is provided with the same number of tube pulling elements 39 (FIG. 3), disposed in a horizontal position, as there are guide tubes 40 through which the embroidery threads OP are guided.

Figure 3:
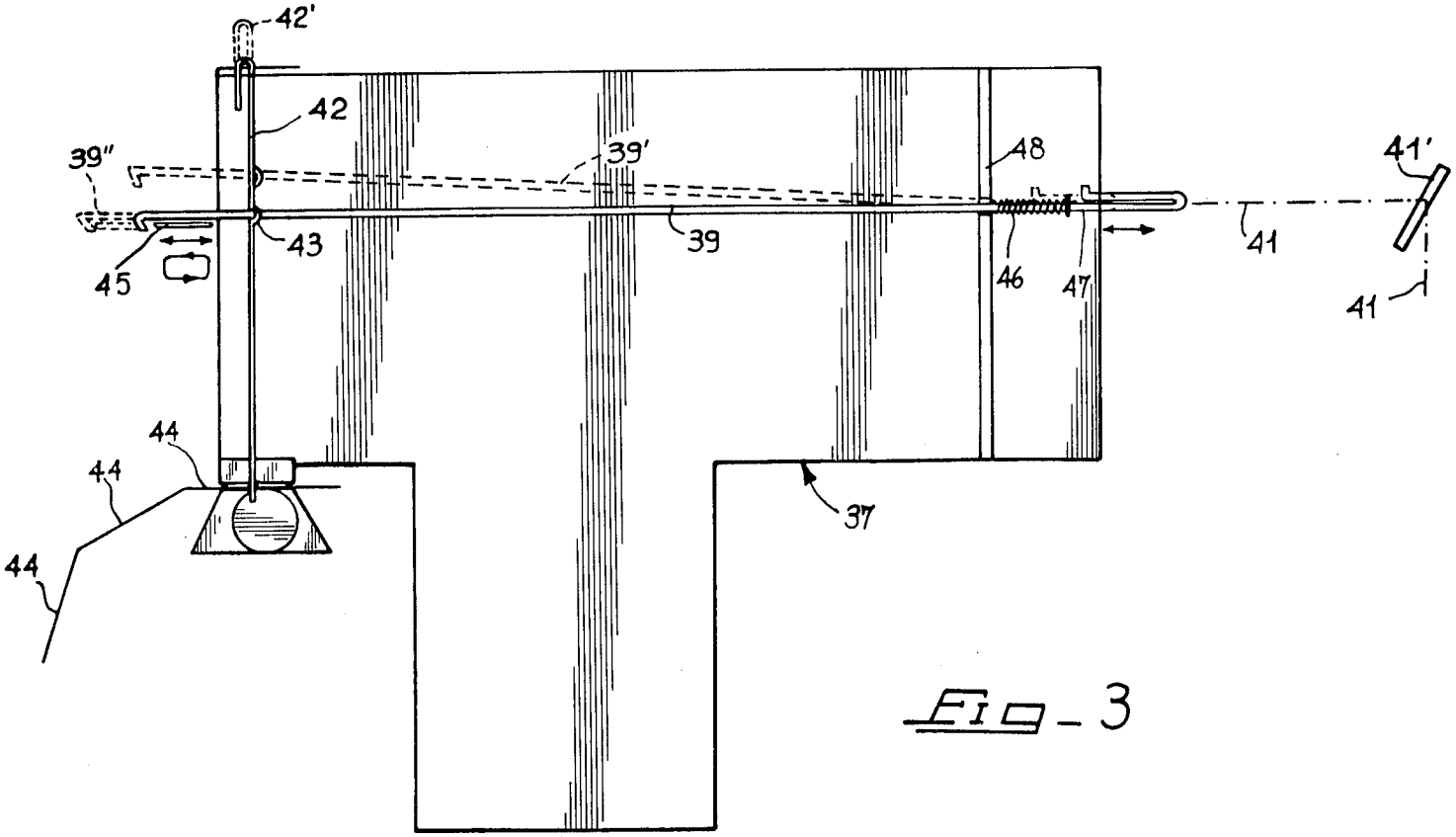
FIG. 3 is a view in side elevation of a portion of the pattern control unit for effecting actuation of the tube pulling elements.

The tube pulling elements 39 and the guide tubes 40 are interconnected by flexible elements or cords 41 and at a location intermediate said pulling elements and guide tubes said cords pass through a guide member depicted in FIG. 3 by numeral 41'. These cords are subjected to programmed pulling action by the tube pulling elements 39 associated therewith that are operatively connected to vertically extending sensing elements 42 by means of an integrally formed eye 43 provided in each said sensing element.

The pattern control unit utilizes pattern cards 44 of the punched type (FIG. 4) that are slidably supported by guide elements 44'. These pattern cards 44 are caused to gradually advance into operation association with the sensing elements 42. At locations on the pattern cards where there are no punched holes, the sensing elements 42 are located in raised position as depicted by numeral 42' and by dashed lines in FIG. 3. With a sensing element in this elevated position its respective tube pulling element 39 is held in an elevated position as indicated by dashed lines identified by numeral 39' in FIG. 3.

The pattern control unit also includes a driven member 45 (FIG. 3) which is caused to travel in a rectangular pathway and when a sensing element 42 is disposed in the position depicted by numeral 42', its respective tube pulling element 39 is also elevated as at 39' and is not acted upon by said driven member. When a sensing element is caused to enter a punched hole in the pattern card 44, the driven member 45 during its travel first raises element 42 removing it from the punched hole in the pattern card and then engages the hooked end of the tube pulling element 39 causing the latter to move to the left a distance corresponding to the dashed lines identified by numeral 39" in FIG. 3. After the underlying card 44 has been advanced the tube pulling element is lowered to bring its respective sensing element into contact with said pattern card and is then caused to move to the right to return it to its initial position and in readiness to repeat the cycle.

During its movement to the left, the tube pulling element 39 reaches the dashed line position 39" which causes its respective cord 41 to be pulled an equal distance. Movement of the cords 41 in this manner causes the guide tubes 40 attached to the lower ends thereof to be moved upwardly with the particular embroidery yarn guided thereby. The return movement of the tube pulling element 39 from the position 39" effected by the driven member 45 is accomplished by a coil spring 46 assembled on and adjacent one end 47 of the tube pulling element 39 whereby one end of said spring is in contact with an inner wall 48 of the housing for the pattern control unit 37.

Figure 2:
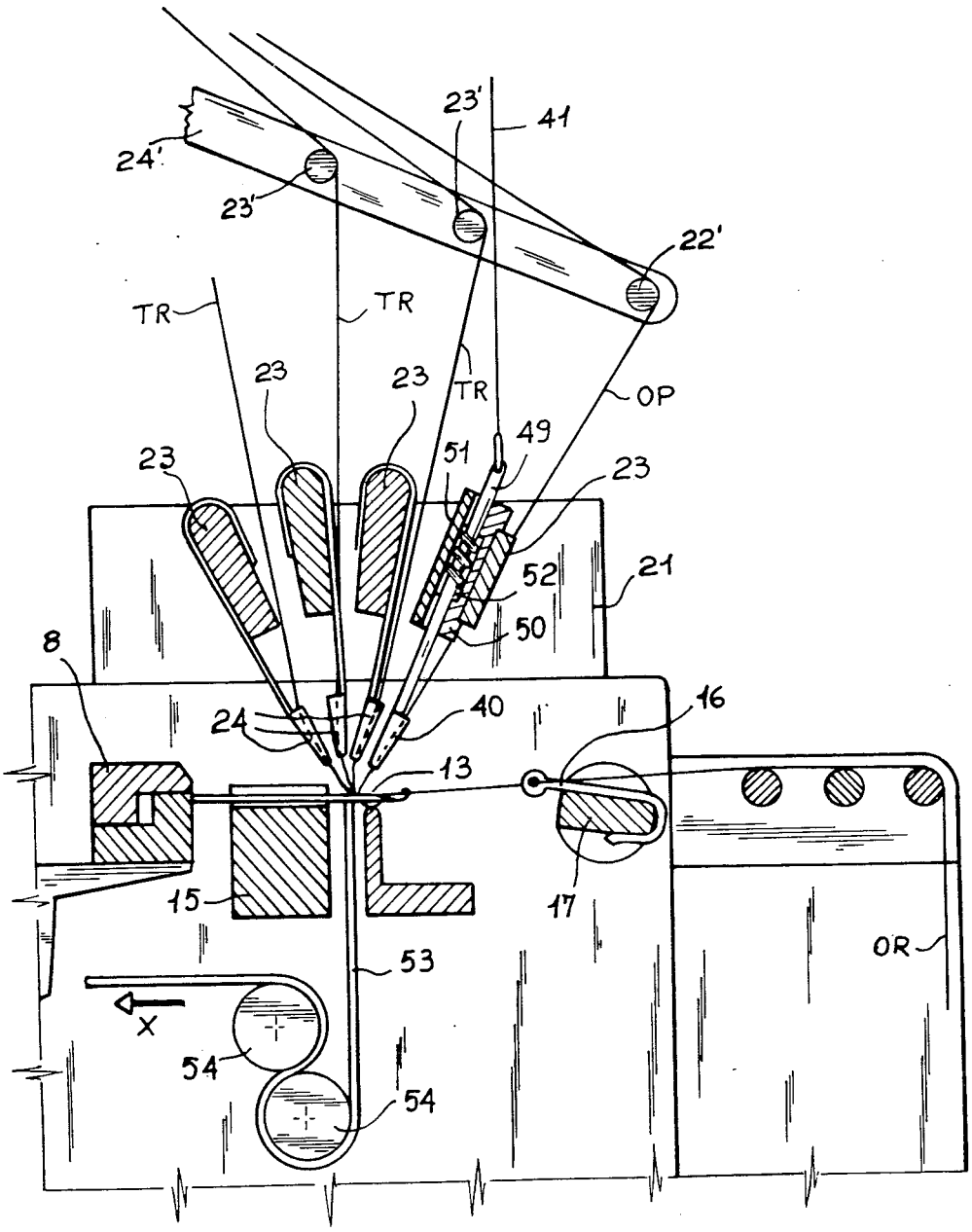
FIG. 2 is a view in side elevation and partially in section of the machine in FIG. 1.

Each cord 41 attached to its respective tube pulling element 39 extends through a guide member 41' and from the latter extends downwardly with its lower end fixed to the upper portion of a rod element 49 which carries a guide tube 40 on the lower end thereof. This rod element 49 is directed generally downward in the direction of the needles 13 on a plate 50 which is supported by one of the bar members 23. As shown in FIG. 2 a coil spring 51 assembles on the rod element 49 in a manner whereby it is disposed within a recess formed in the plate 50 with one end engaging the upper surface of the recess and the lower end being in contact with an integrally formed lug 52 extending laterally from the rod element 42 (FIG. 2). This spring arrangement serves to return the guide tubes 40 to their initial positions after completion of the selection cycle by the pattern control unit 37.

With the embroidery device according to the invention the arrangement of the pattern cards 44 determine the positioning of the tube pulling elements 39 that are connected to the cords 41 and depending on their positions as shown in FIG. 3, they are effective through the driving means 45 of moving selected ones of said pulling elements 39 to the location depicted by numeral 39" and the non-selected ones remain inactive as shown by the elevated pulling element at numeral 39'. The pulling of a cord 41 causes a selected guide tube 40 to be pulled upwardly to prevent them from performing its intended function.

The guide tubes 40 which are pulled upwardly prevent the embroidery threads OP individual to each tube from being linked with the base fabric intermediate contiguous chains to form patterns, but are inserted along those weft chains with which they become interlinked during the last weft thread insertion operation performed. As shown in FIG. 6, where the chain of warp threads OR interlinked with the weft threads TR to form the base fabric, each space or opening indicates that the weft thread has been linked into a single chain. Where the spaces or openings are filled in, indicates that the embroidery thread has been linked to both the left hand chain and the right hand one and vice-versa.

In the preferred embodiment, a total of 448 sensing elements are provided which occupy one half the surface of a pattern card 44. This results in the embroidery device being capable of dimensions of reduced size which permits them to be utilized on conventional crochet machines with looper arrangements. The fabric formed by the machine is identified in FIG. 2 by numeral 53 and is formed by embroidered patterns programmed by the arrangement of the punched holes in the pattern cards 44 and after traveling about the periphery of drums 54 it is caused to leave the machine in the direction of the indicating arrow X in FIG. 2.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. An embroidery device for forming designs on a base fabric with crochet machines having a plurality of needles mounted for movement toward and from warp thread guides for forming chains of warp threads and weft thread tubular guides mounted on a plurality of rectangularly driven bar members for feeding weft threads to the needles to be interlocked with the chains of warp threads, said embroidery device comprising:

(a) means mounted on one of the rectangularly driven bar members for guiding a plurality of embroidery threads;

(b) supplementary vertical drive means operatively connected to said guiding means for elevating selected embroidery threads to effect their insertion within the chains of warp threads when no designs are to appear on the base fabric; and (c) means returning the selected embroidery threads to their initial position upon completion of the function of said supplementary drive means to effect the formation of visible designs on the base fabric.

2. The embroidery device according to claim 1 wherein said guiding means includes a guide tube (40) for each embroidery thread.

3. The embroidery device according to claim 2 wherein each said guide tubes include:

(a) a supporting rod element (49); and (b) individual plates (50) fixed on the rectangularly driven bar member for supporting said rod element for selective sliding movement.

4. The embroidery device according to claim 3 wherein said supplementary vertical drive means defines a pattern control unit (37) including (i) pattern control cards (41) of the punched type;

(ii) sensing elements (42) operatively associated with said pattern control cards; and (iii) means operatively connected to said sensing elements for transmitting the dictates of said pattern cards to said guide tubes (40) for controlling the embroidered designs on the base fabric in accordance with a predetermined pattern.

5. The embroidery device according to claim 4 wherein said transmitting means include:

(i) a tube pulling element (39) for each guide tube (40) operatively connected to a sensing element (42) individual thereto;

(ii) means interconnecting each said tube pulling element (39) with each said guide tube (40); and (iii) means operatively associated with said tube pulling elements for moving non-selected ones thereof a distance sufficient to elevate the guide tube individual thereto a distance to cause its embroidery thread to be inserted within a chain of warp threads.

6. The embroidery device according to claim 5 wherein said interconnecting means defines cord members (41).

7. The embroidery device according to claim 5 wherein said moving means devines a driven member (45) that is caused to travel in a rectangular pathway.

8. The embroidery device according to claim 5 wherein said returning means defines a coil spring (51) assembled on said rod element (49) in operative association with said plate (50).

* * * * *